United States Patent [19]

Brigolle

[11] Patent Number: 4,929,087

[45] Date of Patent: May 29, 1990

[54] METHOD FOR APPLYING VIBRATIONS TO A RESILIENT SUPPORT AND APPARATUS FOR PUTTING THIS METHOD INTO PRACTICE

[75] Inventor: Roger Brigolle, Heulecourt, France

[73] Assignee: Societe Anonyme des Machines Osborn, France

[21] Appl. No.: 33,148

[22] Filed: Apr. 2, 1987

[30] Foreign Application Priority Data

Apr. 2, 1986 [FR] France ..... 86 04681

[51] Int. Cl.[5] ..... B01F 11/00; B22C 15/10

[52] U.S. Cl. ..... 366/111; 74/86; 164/203; 164/260; 366/208

[58] Field of Search ..... 366/108, 110, 111, 208, 366/209, 212, 219, 112; 164/195, 203, 260, 261, 196, 197, 416, 71.1; 74/86; 51/6, 163.1, 163.2; 241/175; 209/331, 332, 366

[56] References Cited

U.S. PATENT DOCUMENTS

| | | | |
|---|---|---|---|
| 639,404 | 12/1899 | Kolls | 366/212 |
| 949,709 | 2/1910 | Kunkel | 366/111 X |
| 1,100,852 | 6/1914 | Thieme | 366/111 |
| 1,437,880 | 12/1922 | Baker | 366/111 X |
| 2,086,241 | 7/1937 | Schaerr | 366/212 |
| 2,486,030 | 10/1949 | James | 366/111 X |
| 3,735,962 | 5/1973 | Pagano | 366/212 |

FOREIGN PATENT DOCUMENTS 2367542 5/1978 France .

*Primary Examiner*—Harvey C. Hornsby
*Assistant Examiner*—Scott J. Haugland
*Attorney, Agent, or Firm*—William A. Drucker

[57] ABSTRACT

A method and apparatus are provided for applying multidirectional vibrations to a resilient support. The excentric of the unidirectional vibration generator cooperates with a spherical shaped member mounted for free rotation on the lower face of the vibrating table connected to the base through springs. The unidirectional vibration generator is carried by a plate parallel to the vibrating table and which is rotated about an axis X—X which is perpendicular thereto, under the action of a motor. This rotation of the unidirectional vibration generator ensures the application of multidirectional vibrations to said table.

4 Claims, 2 Drawing Sheets

METHOD FOR APPLYING VIBRATIONS TO A RESILIENT SUPPORT AND APPARATUS FOR PUTTING THIS METHOD INTO PRACTICE

BACKGROUND OF THE INVENTION

The invention relates to a method for applying multidirectional vibrations to a resilient support as well as the apparatus designed for putting this method into practice.

Generators are known designed for applying unidirectional vibrations to a resilient support. Unidirectional vibration generators are in particular known which include an excentric cooperating with the vibrated resilient mass. There are however cases where the use of such unidirectional vibration generators is not satisfactory, when there is a need to apply multidirectional vibrations to the support to be vibrated. This is in particular the case in foundry, during sandmolding operations during which the sand is vibrated for packing it on the pattern, when the molding must be of high quality, namely when the imprint left in the sand by the pattern must be of a high precision. The unidirectional vibrations generally applied to the sand are in this case not sufficient to provide efficient tamping thereof on the model with respect to the different orientations of the faces thereof.

SUMMARY OF THE INVENTION

The present invention overcomes this drawback by providing a method for applying to a resilient support, from a source of unidirectional vibrations, vibrations which are oriented in multiple directions, as well as an apparatus for putting this method into practice.

In the method of the invention, the source of unidirectional vibrations is driven with a rotational movement in a plane parallel to that of the resilient support, thus causing the direction of the vibrations applied to said support to vary.

The apparatus for putting this method into practice includes a source of unidirectional vibrations cooperating with the resilient support and means which cause the unidirectional vibration generator to rotate in a plane parallel to that of the resilient support.

In one embodiment of the apparatus of the invention, usable particularly in the case of applying multidirectional vibrations to a work table of a sand molding installation in foundry, a generator is used of the excentric type which drives at a given angle a spherical piece mounted freely rotating on the lower face of the vibrating table. The vibrating table is secured against rotation, whereas the vibration generator is mounted on a support plate designed for rotating about a vertical axis passing through the center of gravity of the table, It will be thus understood that during rotation of the support plate, the molding table receives vibrations oriented in all directions so that the friction of the molding sand particles in the rest state carried by the table is reduced, the removal of air is improved and the sand particles, whatever their shapes, settle down into the smallest volume and strongly adhere to each other. The compacting thus achieved provides in addition a better rigidity of the mold.

There may advantageously be disposed, between the excentric driving part of the vibration generator and the rotary support plate, a device comprising for example a rack for obtaining a desired rotation of the vibration generator in the vertical plane for varying the driving angle of the vibrating table. An adjustment during operation of the frequency of the vibrations may be obtained by associating a speed variator with the motor driving the excentric of the generator, and an adjustment during operation of the amplitude of the vibrations may be obtained by mounting the vibration excentric on a second excentric with respect to which it may be rotated, at will, through the desired angle for varying the excentricity of the drive excentric. Such a variation of amplitude during operation is particularly advantageous for application to production line molding where the molds to be vibrated follow each other at regular intervals on the vibrating table. It is then possible, without stopping the drive motor of the vibration generator, that is to say by keeping the most favorable conditions, (vibrations in the vicinity of the natural frequency of the vibrated system) to immobilize the vibrated mold by cancelling out the amplitude of the vibrations and replacing it by the next mold to be vibrated, then returning to the desired amplitude for applying multidirectional vibrations to this next mold without loss of energy.

BRIEF DESCRIPTION OF THE DRAWINGS

For a better understanding of the method of the invention and the apparatus designed for implementing same, a preferred embodiment of this apparatus will be described hereafter with reference to the schematical accompanying drawings in which.

DESCRIPTION OF THE PREFERRED EMBODIMENT

Figure 1:
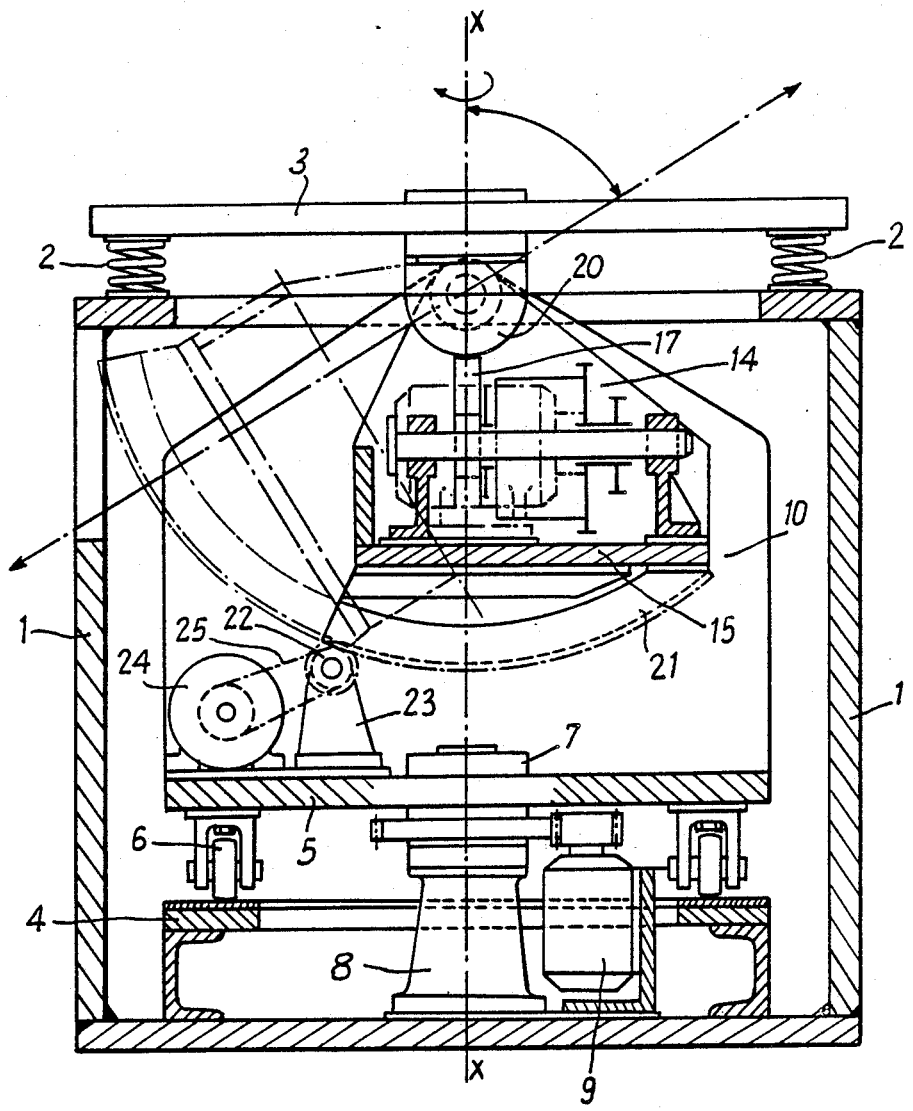
FIG. 1 is a front view, in partial vertical section, of an apparatus for applying multidirectional vibrations to a vibrating table, for example a molding table.
Figure 2:
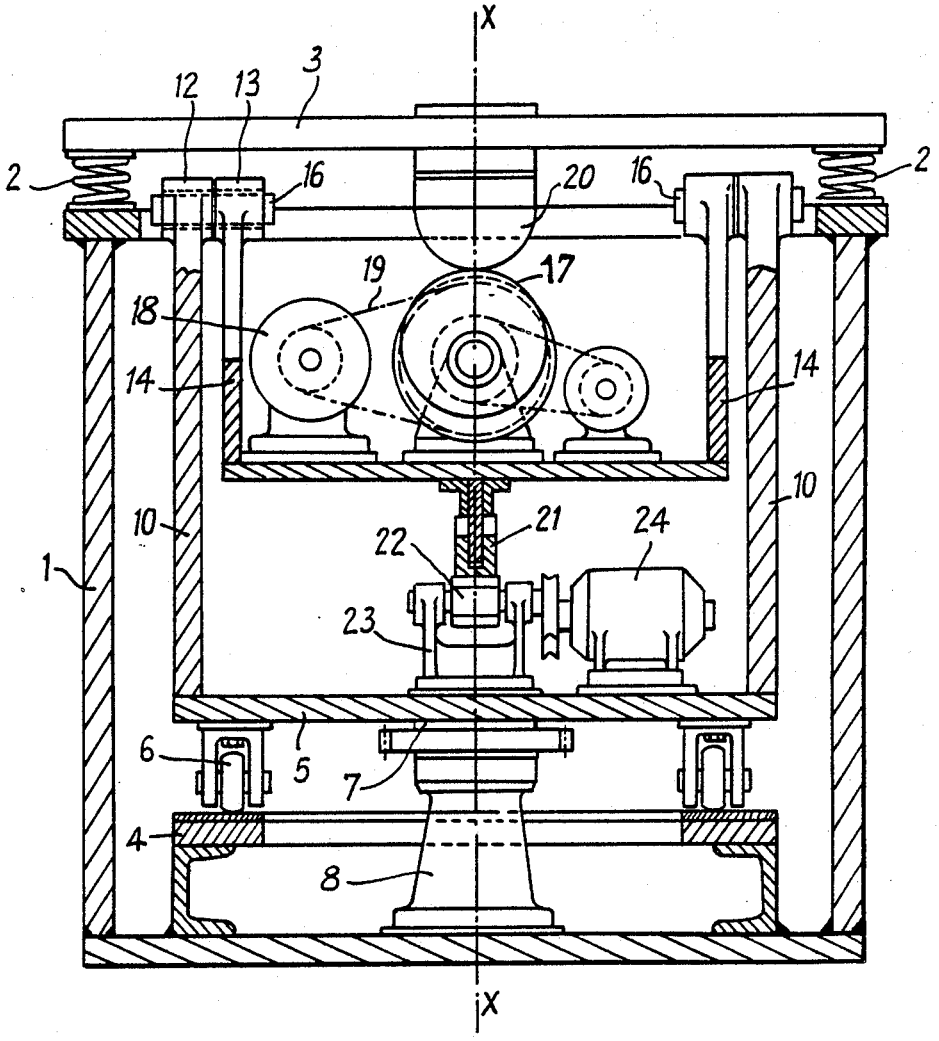
FIG. 2 is a side view, partially in vertical section, of the apparatus of FIG. 1.

Referring to the drawings, a frame is shown at 1 resting on the ground and which supports at its upper part, through four vibration springs 2 with vertical axis, a horizontal plate 3 forming a molding table. At its lower part, frame 1 carries, via a support 4, a horizontal plate 5 which rests on support 4 through rollers 6. At its center, plate 5 is secured to a vertical shaft 7 disposed inside the housing 8 and rotated by a motor 9.

The horizontal plate 5 is fixed at its front and rear ends to vertical trapezoidal walls 10 each having at its upper end a bearing 12 opposite which is disposed a bearing 13 integral with the upper end of each end wall 14 of a cradle 15, pivotally mounted to the walls of the plate 5 by horizontal shafts 16 passing through bearings 12, 13. Cradle 15 comprises the unidirectional vibration generator such as described in French patent 2 367 542, that is to say including a vibration excentric 17 driven in rotation by a motor 18 and a belt 19 and engaging a spherical element 20 mounted for free rotation on the lower face of the molding table 3 close to the center of gravity thereof.

Cradle 15 has fixed to its lower face a rack 21 in the form of an arc of a circle, adapted for meshing with a pinion 22 mounted for rotation in a fork joint 23 carried by plate 5. A power driven reducing unit 24, also carried by plate 5, is adapted for rotating the pinion 22 through a belt 25. By rotation of pinion 22, the inclination of cradle 15 about axes 16 can be adjusted and so the angle of driving the spherical part 20 by the vibration excentric 17.

So as to allow adjustment during operation of the amplitude of the vibrations delivered by the excentric 17, this latter is mounted, as divulged in the French patent 2 367 542, on a control shaft 26 via an inner excentric forming a hub. A differential pulley 28 is mounted on shaft 26 and, through a pinion fixed to the differential bevel gear, a ring gear carried by the excentric 17. A step by step brake motor 29 controls the differential pulley for adding or subtracting a chosen rotational movement to or from the excentric 17 so as to shift this latter with respect to the hub 27 for varying the excentricity.

The operation of the apparatus is readily understandable from the foregoing description, with the device in the position shown in FIG. 1, the power driven reducer 24 is actuated for adjusting the drive angle of the rotating spherical part 20 then the inner excentric 27 is adjusted so as to cancel out the excentricity of the vibration excentric 17. Using the motor 18, the excentric 17 is rotated at a speed adapted for producing a vibration frequency close to the natural frequency of the table to be vibrated, then by actuating the step by step motor 29 unidirectional vibrations are applied to table 3 by causing the amplitude of this vibration to pass from 0 to the desired value. By controlling motor 9, plate 5 is then caused to rotate about the vertical axis X—X while driving the spherical part 20 by the excentric 17 in multiple directions, thus imparting to the molding table 3 the desired multidirectional vibrations. In the case of a molding production line, in which the molds to be packed pass successively over the same molding table at given time intervals, when the vibration period of the mold disposed on table 3 is finished, the amplitude of the vibrations may be advantageously brought back to zero by controlling the step by step motor 29 without modifying the operation of the other elements of the device, the vibrated mold on the now motionless table 3 may be replaced by a new mold and then the amplitude of the vibrations brought gradually to the desired value without having to restart the different rotary members.

As a variant, the spherical element 20 carried by the lower face of the molding table 3 could be fixed and cooperate with the excentric 17 through a needle bearing (not shown).

It will be readily understood that the present description has been given solely by way of example, without any limitative character, and that constructional additionals or modifications could be made thereto without departing from the scope and spirit of the invention defined by the following claims. In particular, the apparatus of the invention has been described as relating to the application of multidirectional vibrations to molding tables, but the invention could relate to the application of multidirectional vibrations to other types of resilient supports to be vibrated.

What is claimed is:

1. A method for applying multidirectiional vibrations to a resilient support, which comprises the steps of:

(a) securing said resilient support against rotation in its plane, (b) applying to the resilient support unidirectional vibrations from a unidirectional vibration generator, (c) simultaneously with step (b) rotating said unidirectional vibration generator in a plane parallel to the plane of said resilient support, and (d) simultaneously with steps (b) and (c) pivoting said unidirectional vibration generator in a plane perpendicular to the plane of said resilient support.

2. An apparatus for applying multidirectional vibrations orientated in three mutually perpendicular directions to resilient support, which comprises:

(a) means for securing the resilient support against rotation in its plane, (b) a single generator of unidirectional vibrations, (c) a member connected to the resilient support and coacting with an active part of said generator of unidirectional vibrations, (d) a plate bearing said generator of unidirectional vibrations, (e) means for rotating said plate bearing the generator of unidirectional vibrations in a plane parallel to the plane of the resilient support, and (f) means disposed between said plate and said generator of unidirectional vibrations to simultaneously vary inclination of the generator of unidirectional vibrations in a plane perpendicular to the plane of the resilient support.

3. An apparatus as claimed in claim 2 wherein said generator of unidirectional vibrations is carried in a plane which is parallel to said resilient support and which is rotated about an axis perpendicular thereto.

4. An apparatus as claimed in claim 3 wherein said unidirectional vibration generator includes a vibration eccentric which is driven in rotation, said member connected to the resilient support comprising a rotatable spherical member which is mounted on a lower face of the resilient support and cooperate with the vibration eccentric.

* * * * *